United States Patent [19]

Chikano et al.

[11] Patent Number: 4,801,981

[45] Date of Patent: Jan. 31, 1989

[54] PAPER FEEDING ARRANGEMENT

[75] Inventors: Hisao Chikano; Takashi Yokota, both of Tokyo, Japan

[73] Assignee: Ricoh Company, Ltd., Tokyo, Japan

[21] Appl. No.: 107,999

[22] Filed: Oct. 14, 1987

[30] Foreign Application Priority Data

Oct. 14, 1986 [JP] Japan ..... 61-241934
Nov. 7, 1986 [JP] Japan ..... 61-265012

[51] Int. Cl.[4] ..... G03G 15/00

[52] U.S. Cl. ..... 355/3 SH; 346/134; 355/14 SH

[58] Field of Search ..... 346/108, 107 R, 134, 346/136, 76 L; 355/3 SH, 14 SH; 358/302, 296; 206/511, 512, 509

[56] References Cited

U.S. PATENT DOCUMENTS 4,405,225 9/1983 Perrault ..... 355/3 SH

FOREIGN PATENT DOCUMENTS 0041057 3/1985 Japan ..... 355/14 SH
188785 11/1922 United Kingdom ..... 220/97

*Primary Examiner*—E. A. Goldberg
*Assistant Examiner*—Huan H. Tran
*Attorney, Agent, or Firm*—Oblon, Fisher, Spivak, McClelland & Maier

[57] ABSTRACT

An improvement in the structure for connecting various optional units to the body of a printer, copier or like recording apparatus and to each other. The optional units include a mass feed unit for feeding a large amount of paper sheets, a stack unit for stacking paper sheets discharged, and a re-feed unit for conditioning copies for re-feed. The optional units are accurately matched to each other and to the apparatus body when they are connected to the latter, without resorting to changes in the configuration of paper transport paths. Any of the units which has an outlet opening is provided with a device for changing the direction of transport of an outgoing paper sheet.

2 Claims, 5 Drawing Sheets

PAPER FEEDING ARRANGEMENT

BACKGROUND OF THE INVENTION

The present invention relates to a paper feeding arrangement for a printer, copier and other recording apparatuses and, more particularly, to an improvement in the connection between such a recording apparatus and a mass feed unit for feeding a large amount of paper sheets, stack unit for stacking paper sheets discharged, re-feed unit for conditioning copies for re-feed, and other optional units, as well as in the connection between such units themselves.

Generally, in a recording apparatus of the kind described, a paper sheet or like recording medium fed into the apparatus and, then, subjected to a recording or copying process is driven out of the apparatus. While many of such recording apparatuses are provided with a medium feed and a medium discharge system in its housing, there is an increasing demand for, in addition to those systems, a mass feed section having a greater capacity than the conventional medium feed system as well as for a capability of allowing the medium to be selectively discharged in various different modes. To meet this demand, there have been proposed a recording apparatus having a mass feed section in its housing, and a recording apparatus selectively operable with independent units which may be connected to the apparatus as needed. A drawback with the first-mentioned approach is that the apparatus is bulky and, because the mass feed section is not separable from the housing, incapable of integrating various functions according to user's demands. On the other hand, the second-mentioned approach has a problem that the function attainable is not more than a simple paper handling function since the optional units to be connected are not identical in the manner and/or the structure for connection. In addition, in the case that the direction of paper transport differs from one unit to another, there has to be used those units the manner and structure for connection of which are identical with regard to the direction of paper feed.

SUMMARY OF THE INVENTION

It is, therefore, an object of the present invention to provide a paper feeding arrangement which matches itself to a multi-function configuration of a printer or like recording apparatus.

It is another object of the present invention to provide a paper feeder which matches itself to multi-mode paper discharge of a printer or like recording apparatus.

It is another object of the present invention to provide a paper feeding arrangement which improves the matching between a printer or like recording apparatus and an optional unit such as a mass feed unit, a discharge unit, a stack unit or a re-feed unit which may be connected to the printer, and the matching between those optional units themselves.

It is another object of the present invention to provide a generally improved paper feeder.

In a structure for interconnecting various structural elements of a system which is constituted by a recording apparatus and various structural elements of a plurality of optional paper handling units connectable to the recording apparatus, the improvement in accordance with the present invention is characterized in that a first structural element having an outlet opening for transporting a paper sheet and a second structural element having an inlet opening for receiving the paper sheet are communicated to each other with the outlet and inlet openings aligned with each other, and in that the paper sheet is transported through the outlet opening in a same direction as the paper sheet is transported through the inlet opening.

The above and other objects, features and advantages of the present invention will become more apparent from the following detailed description taken with the accompanying drawings.

DESCRIPTION OF THE PREFERRED EMBODIMENTS

Figure 1:
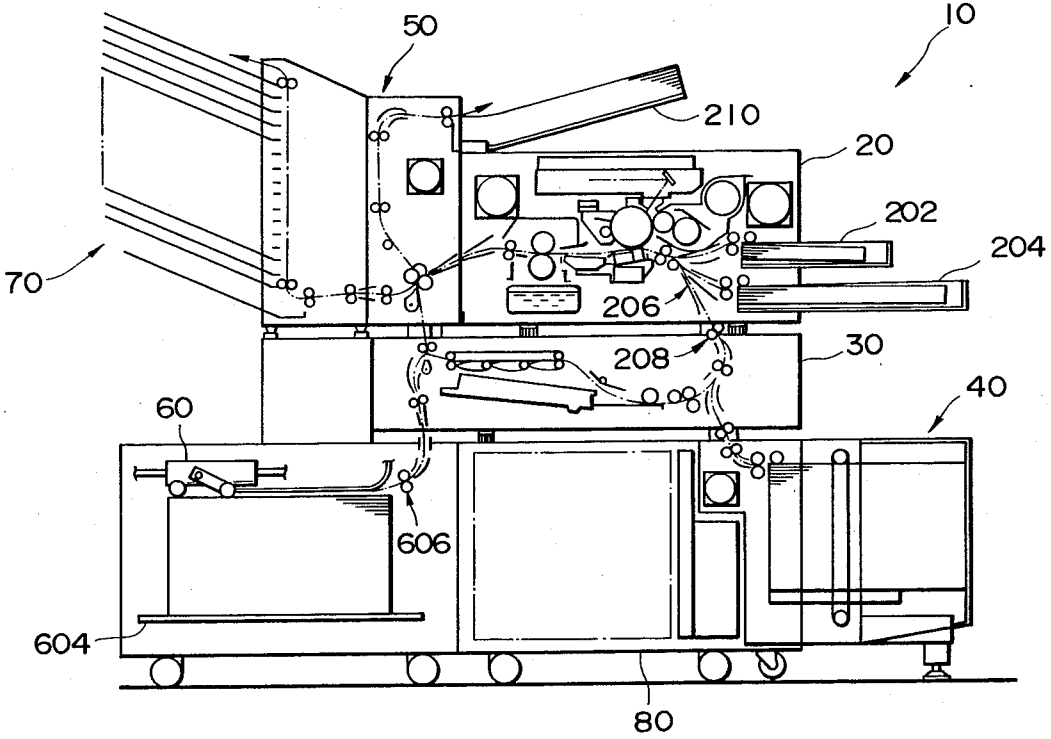
FIG. 1 is a view showing the overall construction of a laser printer system to which a paper feeding arrangement of the present invention is applied.

Referring to FIG. 1, a laser printer system which is an example of recording apparatuses is shown and generally designated by the reference numeral 10. As shown, the system 10 is made up of a laser printer 20, five optional peripheral units, i. e. , a re-feed unit 30, a mass feed unit 40, a discharge unit 50, a stack unit 60, and a sorter 70, and a system table 80.

Figure 2:
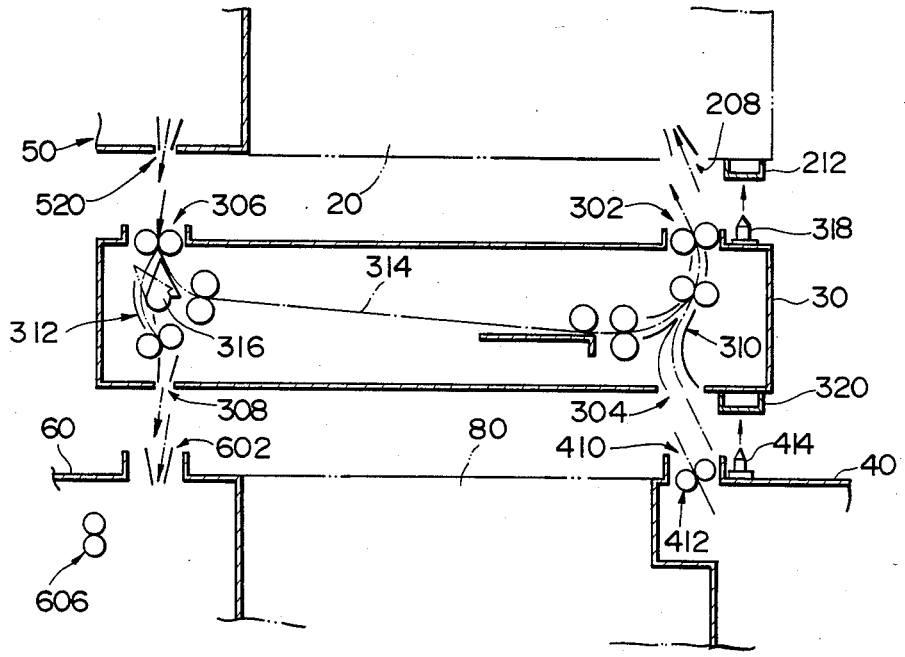
FIG. 2 is a fragmentary sectional side elevation a re-feed unit of the laser printer system as shown in FIG. 1.

Installed in the body of the laser printer 20 is an electrophotographic recording device having a laser recording section in which an exposing means, or write unit, photoelectrically converts an externally derived video signal so as to raster-scan a photoconductive element by a laser beam. Two paper cassettes 202 and 204 are detachably mounted in the laser printer 20 to selectively feed recording media, or paper sheets, toward the photoconductive element. A paper transport path 206 joins those paper transport paths which individually extend from the paper cassettes 202 and 204. The bottom of the printer body at which the paper transport path 206 terminates is provided with an inlet opening 208 which communicates with an outlet opening 302, FIG. 2, of the re-feed unit 30. Specifically, as shown in FIG. 2, the inlet opening 208 is positioned in correspondence to the outlet opening 302, and a paper sheet enters the inlet opening 208 in the same direction as it leaves the outlet opening 302.

Figure 3:
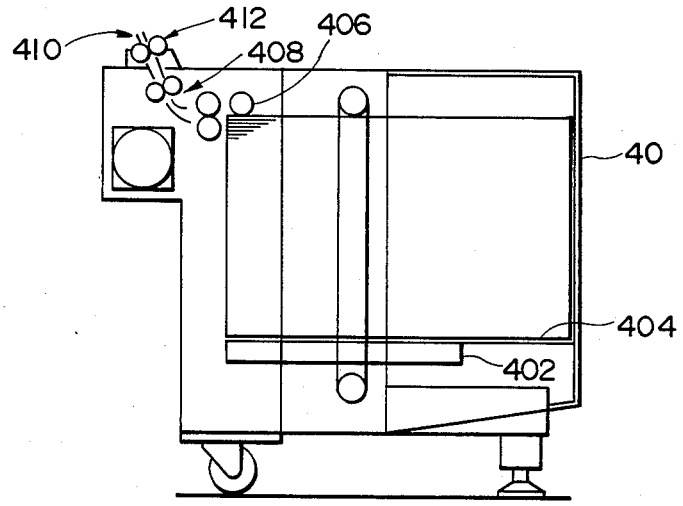
FIG. 3 is a view showing the overall construction of a mass feed unit which is included in the system of FIG. 1.

As shown in FIG. 1, the mass feed unit 40 is positioned below the re-feed unit 30. As shown in detail in FIG. 3, the mass feed unit 40 includes an elevator 402, a platform 404 provided integrally with the elevator 402 to be loaded with a stack of paper sheets, and a feed roller 406 located at a position where the uppermost sheet of the stack is to be fed. A transport section 408 is defined at the feed position by a plurality of roller pairs and guide plates. A top plate of the unit 40 at which the transport section 408 terminates is provided with a discharge section 410 having a pair of rollers 412. As shown in FIG. 2, the discharge section 410 is positioned in correspondence to a first inlet opening 304 which is formed through the bottom of the re-feed unit 30, a paper sheet being transported by the roller pair 412 in the same direction as it is driven through the inlet opening 208 of the laser printer 20.

Figure 4:
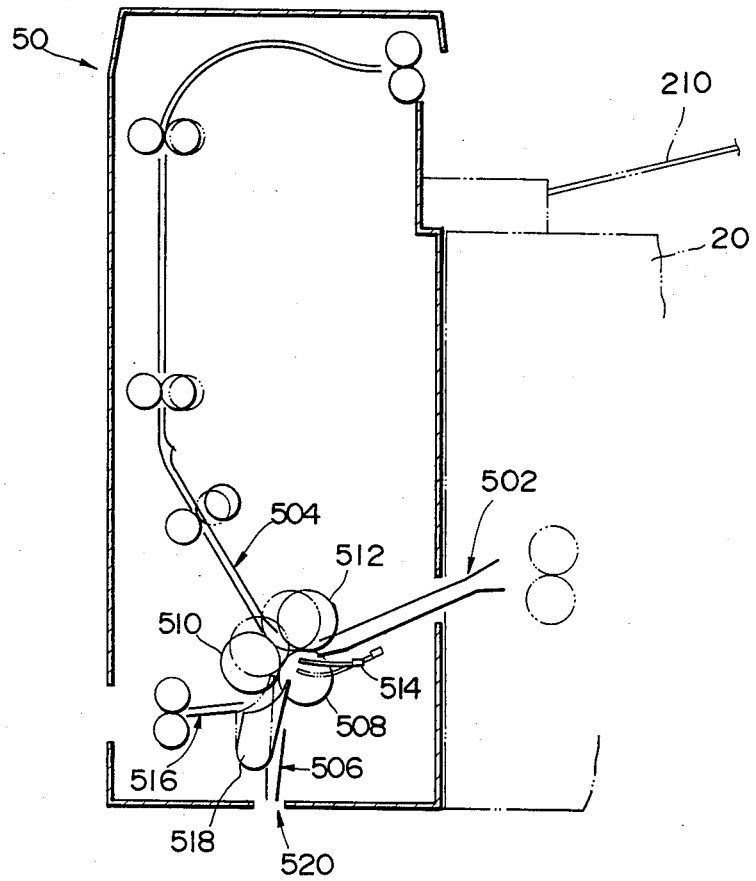
FIG. 4 is a view showing the overall construction of a discharge unit as also included in the system of FIG. 1.

The discharge unit 50 is disposed on that side of the laser printer 20 where a paper sheet having undergone a fixing step comes out of the laser printer 20. As shown in FIG. 4, the discharge unit 50 has an inlet transport path 502 adapted to guide a paper sheet coming out of the laser printer 20. The end of the path 502 branches into an upper transport path 504 for guiding a paper sheet toward a discharge tray 210 (see FIG. 1 also) which is provided on the top of the laser printer 20, and a lower transport path 506 for guiding a paper sheet toward the re-feed unit 30. Located at the branching point of the path 502 are a first roller 508 rotatable in a fixed position, a second and a third roller 510 and 512, respectively, capable of changing their positions in contact with the roller 508, and a guide 514 movable into and out of the path 502. The second rollers 510 and 512 and the guide 514 are adapted to select a particular transport direction for a paper sheet which is introduced into the path 502, i. e. , they selectively cause a paper sheet to be guided by the upper and lower paths 504 and 506 which are contiguous with the path 502. Further, a left transport path 516 branches off the lower transport path 506 to extend toward the sorter 70, FIG. 1. A pawl 518 movable into and out of path 506 is disposed in the branching position of the path 516 so as to change over the direction of paper transport. The path 506 terminates at a lower discharge opening 520 which is formed through the bottom of the discharge unit 50. As shown in FIG. 2, the lower discharge opening 520 is positioned in correspondence to a second inlet opening 306 of the re-feed unit 30, and a paper sheet driven is driven through the opening 520 in the same direction as it is driven through the opening 306.

Figure 5:
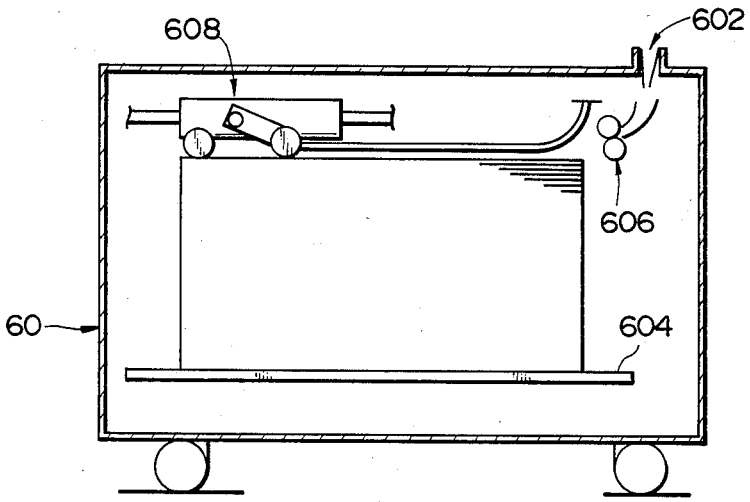
FIG. 5 is a view showing the overall construction of a stack unit as furhter included in the system of FIG. 1.

The stack unit 60 is disposed below the re-feed unit 30. As shown in FIG. 5, the stack unit 60 is provided at its top with an inlet opening 602 which corresponds in position to an outlet opening 308, FIG. 2, of the re-feed unit 30. Installed in the stack unit 60 are a paper loading section 604 which is implemented with an elevator, a sorting roller 606 located in the vicinity of the inlet opening 602, and a presser roller 608. The sorting roller 606 is movable in its axial direction to sort paper sheets, which come out of the laser printer 20, by changing the position of the paper sheets depending upon the job selected. The presser roller 608 is movable in the direction in which a paper sheet enters the unit 60, pulling the incoming paper sheet to stack it on the loading section 604.

The mass feed unit 40 and the stack unit 60 are each operated docked with the system table 80.

Figure 6:
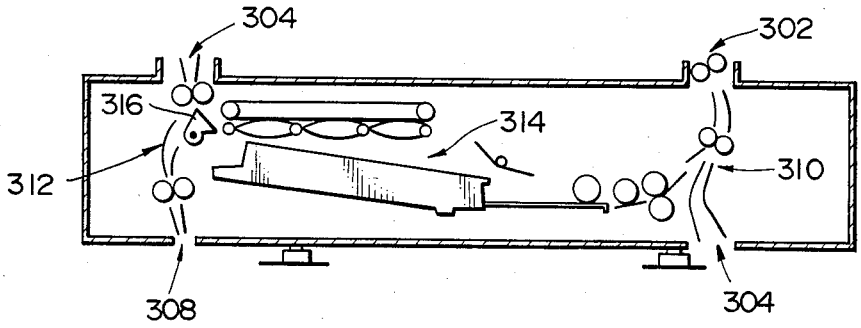
FIG. 6 is a view showing the overall construction of the re-feed unit.

The re-feed unit 30 is disposed between the bottom of the laser printer 20 and the top of the system table 80. As shown in FIG. 6, the re-feed unit 30 is provided with an outlet opening 302 at its upper right-hand side which communicates with the inlet opening 208 of the printer 20. A first inlet opening 304 is formed through the bottom of the re-feed unit 30 in alignment with the outlet opening 302, communicating with the discharge section 410 of the mass feed unit 40. A paper sheet is transported through the aligned openings 302 and 304 in the same direction as it is transported through the discharge section 410 of the mass feed unit 40. Extending between the first inlet opening 304 and the outlet opening 302 is a first transport path 310. Further, the unit 30 is provided with a second inlet opening 304 at its upper left side which communicates with the lower outlet opening 520 of the discharge unit 50. An outlet opening 308 is formed through the bottom of the unit 30 in alignment with the inlet opening 304, communicating with the inlet opening 602 of the stack unit 60. Extending between the aligned openings 304 and 308 is a second transport path 312. The second transport path 312 branches toward the first transport path 310 to define a third transport path 314. A pawl 316 movable into and out of the path 312 is positioned at the branching point of the path 312.

As shown in FIG. 2, the re-feed unit 6030 is provided with a projection member 318 and a recess member 320 on its top and bottom walls, respectively. On the other hand, the bottom of the laser printer 20 is provided with a recess member 212 to mate with the projection member 318, and the top of the mass feed unit 40 is provided with a projection member 414 to mate with the recess member 320.

In the above system construction, the mass feed unit 40 and the stack unit 60 are docked with the system table 80 so as to position the units 40 and 60. Then, the re-feed unit 30 is mounted on the system table 80 by mating the recess member 320 of the unit 30 with the projection member 414 of the unit 40, whereby the first inlet opening 304 and the outlet opening 410 are positioned relative to each other. This also positions the outlet opening 308 of the unit 30 and the inlet opening 602 of the unit 60 relative to each other. Further, the laser printer 20 is mounted on the re-feed unit 30 by mating the recess member 212 of the printer 20 with the projection member 318 of the unit 30, whereby the outlet opening 302 of the unit 30 and the inlet opening 208 of the printer 20 are positioned relative to each other.

In the above condition, a paper sheet coming out of the mass feed unit 40 is routed through the outlet opening 410 to the first inlet opening 304 of the re-feed unit 30 and, then, to the inlet opening 208 of the laser printer 20 by way of the first transport path 310 of the unit 30. Finally, the paper sheet is transported to a predetermined transfer station through the transport path 206 and at a predetermined registration timing. On the other hand, a paper sheet having undergone a fixing step is introduced into the inlet transport path 502 of the discharge unit 50 and, based on a transport mode selected, routed to one of the discharge tray 210, sorter 70 and stack unit 60 by the second and third rollers 510 and 512, guide 54, and pawl 518.

Figure 7:
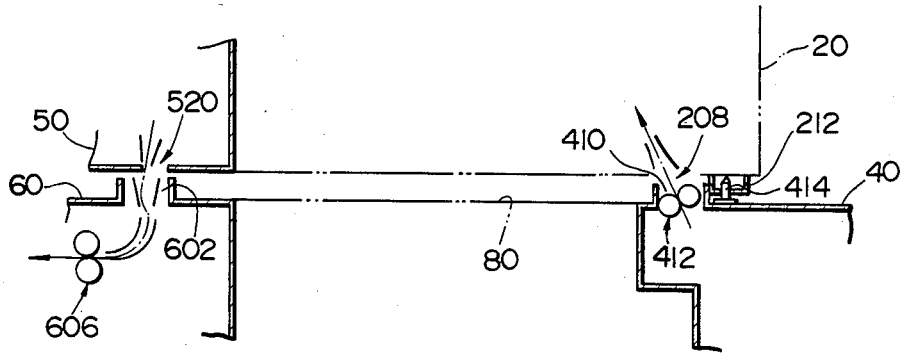
FIG. 7 is a section showing a modification to the re-feed unit of FIG. 1.

Assume that the laser printer 20 is mounted on the mass feed unit 40 without the intemediary of the re-feed unit 30, as shown in FIG. 7. In such a case, all that is required is mating the projection member 414 of the mass feed unit 40 with the recess member 212 of the printer 20 so as to position the outlet opening 410 of the unit 40 and the inlet opening 208 of the printer 20 relative to each other.

In the above embodiment, the arrangement is fixed such that a paper sheet is driven through the discharge section 410 of the mass feed unit 40 in the same direction as it is driven through the first inlet opening 304 of the re-feed unit 30. Alternatively, the direction of paper transport through the discharge section 410 may be made variable to coincide with, for example, the direction of paper transport through a first inlet opening of another re-feed unit 30 which is different from the previously mentioned direction of paper transport. Another specific construction of the mass feed unit which is furnished with such an implementation will be described with reference to FIGS. 8 to 10.

Figure 8:
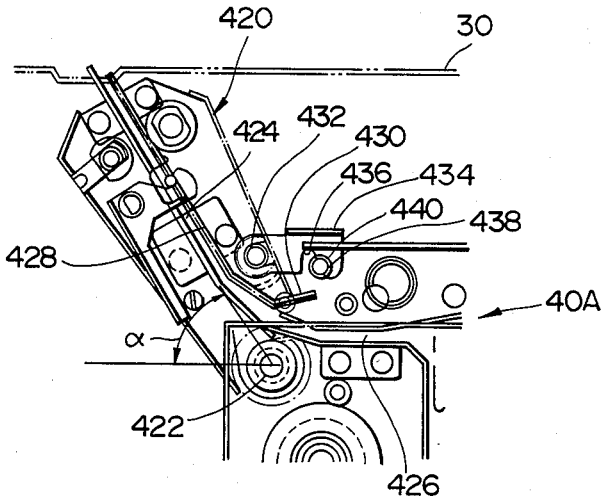
FIGS. 8 and 9 are sectional side elevations showing a modification to the mass feed unit of FIG. 1.
Figure 9:
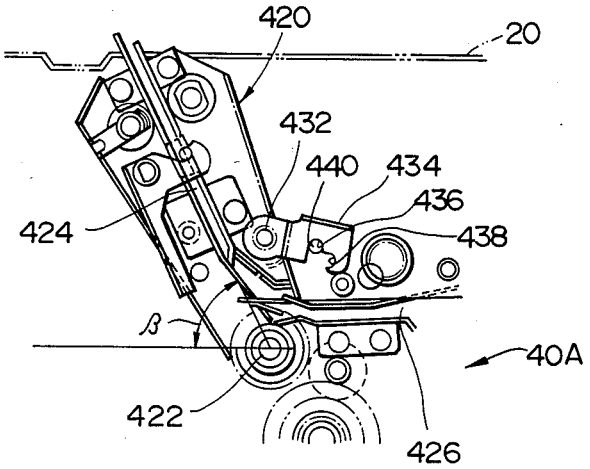

As shown in FIGS. 8 and 9, the alternative mass feed unit 40A includes a discharge section 420 which is rotatable about a shaft 422 over a certain angular range. Supported by the unit 40A, the shaft 422 is located in the vicinity of a point at which a transport path 424 of the discharge section 420 and a transport path 426 extending from the paper loading platform join each other. A guide plate 428 which defines the transport path 424 includes a horn-like inlet portion 430 which guarantees smooth paper transport even when the angular position of the discharge section 420 relative to the horizontal is slightly changed. A lock member 434 is pivotally mounted to a pin 432 which is studded at a slightly spaced position from the shaft 422. The lock member 434 is provided with two recesses 436 and 438. These recesses 436 and 438 are selectively engaged with a pin 440 which is studded on the unit 40A. Specifically, FIG. 8 shows a condition wherein the recess 438 is engaged with the pin 440 maintaining the transport path 424 of the discharge section 420 at an angle a as measured from the horizontal. In this condition, when a paper sheet is to be fed from the mass feed unit 40A to the re-feed unit 30, the transport path 420 is aligned with the first transport path 310 of the re-feed unit 30 which is angled by $\alpha$, allowing a paper sheet to be smoothly transported.

FIG. 9, on the other hand, shows a condition in which the other recess 436 of the lock member 434 is engaged with the pin 440 holding the transport path 424 of the discharge section 420 at an angle $\beta$ to the horizontal. This maintains the transport path 424 in alignment with, for example, the transport path 206, FIG. 1, of the printer 20 to which the mass feed unit 40A is connected.

If desired, the tip portion of the pin 440 may be screw-threaded to allow a nut to be engaged with the screw-thread after the engagement of any of the recesses of the lock member 434 with the pin 440. Such would eliminate the play of the discharge section 420.

Figure 10:
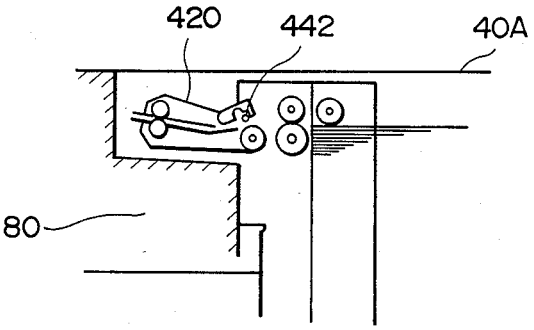
FIG. 10 is a view showing a relationship between the mass feed unit of FIGS. 8 and 9 and a system table.

FIG. 10 shows how the mass feed unit 40A is loaded on the system table 80. As shown, the recess 438 of the lock member 434 is engaged with a pin 442 which is studded on an adequate part of the framework of the unit 40A, so that the discharge section 420 of the unit 40A does not protrude upward beyond the top of the system table 80 and remains above the bottom of a recessed portion of the system table 80. In this configuration, the unit 40A may be moved horizontally into connection with the system table 80 without interfering with the system table 80 and any unit which may be mounted on the system table 80. After the connection of the unit 40A to the system table 80, one of the recesses 436 and 438 is mated with the pin 440 in matching relation to a unit which is mounted on the system table 80. This causes the discharge section 420 to remain in a particular inclination which conforms to the unit.

No doubt, the lock member 434 may be provided with three or more recesses in order to selectively position the discharge section 420 in any of three or more different inclinations as may be required depending upon the kind of the unit to be connected. Further, a plurality of pins 440 may be provided in which case a single recess suffices.

While the discharge section capable of changing the direction of paper transfer has been shown and described as being installed in a mass feed unit, it is similarly applicable to the other units as well to any other unit which includes a discharge section.

In summary, it will be seen that the present invention achieves various unprecedented advantages, as enumerated below.

(1) In the case that various units are connected to a laser printer or like recording apparatus, the units can be matched to each other and to the recording apparatus without the need for the changes in the configuration of paper transport paths. Hence, optional units can be easily increased or decreased in number as desired.

(2) The optional units can be readily positioned relative to each other and to the recording apparatus.

(3) Hence, a multi-function printer system is implemented.

Various modifications will become possible for those skilled in the art after receiving the teachings of the present disclosure without departing from the scope thereof.

What is claimed is:

1. In a structure for interconnecting various structural elements of a system which is constituted by a recording apparatus and various structural elements of a plurality of optional paper handling units connectable to said recording apparatus, a first structural element having an outlet opening for transporting a paper sheet and a second structural element having an inlet opening for receiving the paper sheet communicated to each other with said outlet and inlet openings aligned with each other, wherein the paper sheet is transported through said outlet opening in a same direction as the paper sheet is transported through said inlet opening, wherein said first structural element is provided with a transport direction changing means for changing an intended direction of transport of a paper sheet which is moved through said outlet opening, and wherein said transport direction changing means comprises a discharge mechanism for driving a paper sheet to said outlet opening, said discharge mechanism being supported to be rotatable about a predetermined point, and a positioning device for positioning said discharge mechanism, said positioning device comprising a lock member provided on said discharge mechanism and a member for selectively locking said lock member in a plurality of positions.

2. The improvement as claimed in claim 1, wherein a means is provided for maintaining said transport direction changing means in a position where said first structural element does not interfere with said second structural element when connected to said second structural element.

* * * * *

UNITED STATES PATENT AND TRADEMARK OFFICE

CERTIFICATE OF CORRECTION

PATENT NO. : 4,801,981

DATED : Jan. 31, 1989

INVENTOR(S) : Hisao CHIKANO, et al.

It is certified that error appears in the above-identified patent and that said Letters Patent is hereby corrected as shown below:

The Title page is corrected to indicate 6 Drawing Sheets.

Signed and Sealed this

Eighteenth Day of July, 1989

*Attest:*

DONALD J. QUIGG

*Attesting Officer*

*Commissioner of Patents and Trademarks*